United States Patent [19]

van Wijk

[11] Patent Number: 4,897,115

[45] Date of Patent: Jan. 30, 1990

[54] METHOD OF, PURIFYING A MELT, WHICH, BESIDES ONE OR MORE IMPURITIES, ESSENTIALLY CONTAINS A LIGHT METAL, IN PARTICULAR ALUMINUM

[76] Inventor: Gijsbert W. van Wijk, Baalder Esch 41, 7772 JX Hardenberg, Netherlands

[21] Appl. No.: 273,593

[22] Filed: Nov. 21, 1988

Related U.S. Application Data

[62] Division of Ser. No. 44,928, May 1, 1987, Pat. No. 4,842,643.

[30] Foreign Application Priority Data

May 6, 1986 [NL] Netherlands ..... 8601158

[51] Int. Cl.[4] ..... C22B 9/04

[52] U.S. Cl. ..... 75/63; 75/68 R

[58] Field of Search ..... 75/68 R, 63

[56] References Cited

U.S. PATENT DOCUMENTS 3,895,937 7/1975 Gjosteen et al. ..... 75/68 R
4,456,479 6/1984 Harris et al. ..... 75/68 R

FOREIGN PATENT DOCUMENTS 825007 12/1951 Fed. Rep. of Germany .
2143154 3/1973 Fed. Rep. of Germany .
2425808 1/1975 Fed. Rep. of Germany .
1227666 3/1960 France .
1096295 6/1984 U.S.S.R. ..... 75/68 R

*Primary Examiner*—Melvyn Andrews
*Attorney, Agent, or Firm*—Mark T. Basseches; Paula T. Basseches

[57] ABSTRACT

Apparatus for purifying a melt which, besides one or more impurities to be volatilized, contains essentially a light metal, in particular aluminum. The apparatus comprises a vacuum processing vessel, a vacuum pump, one or more conduits for supplying the melt to the vacuum processing vessel and means for spraying the melt into the vacuum processing vessel. According to the invention, the vacuum processing vessel is provided with discharge means for discharging impurities expelled from the melt. The discharge means are connected to a means for separating the impurities in solid or liquid form, connected to the vacuum pump used for maintaining the subatmospheric pressure in the vacuum processing vessel. Connected to the vacuum processing vessel are at least one supply conduit and one return conduit for the melt, the supply conduit being provided with a pump for the melt to be purified and a spray nozzle for atomizing the melt supplied by the pump into the vacuum processing vessel.

During the purification treatment, a subatmospheric pressure is maintained in the apparatus by the vacuum pump, and the temperature of the melt is maintained at 600°-900° C.

9 Claims, 1 Drawing Sheet

Figure 1:
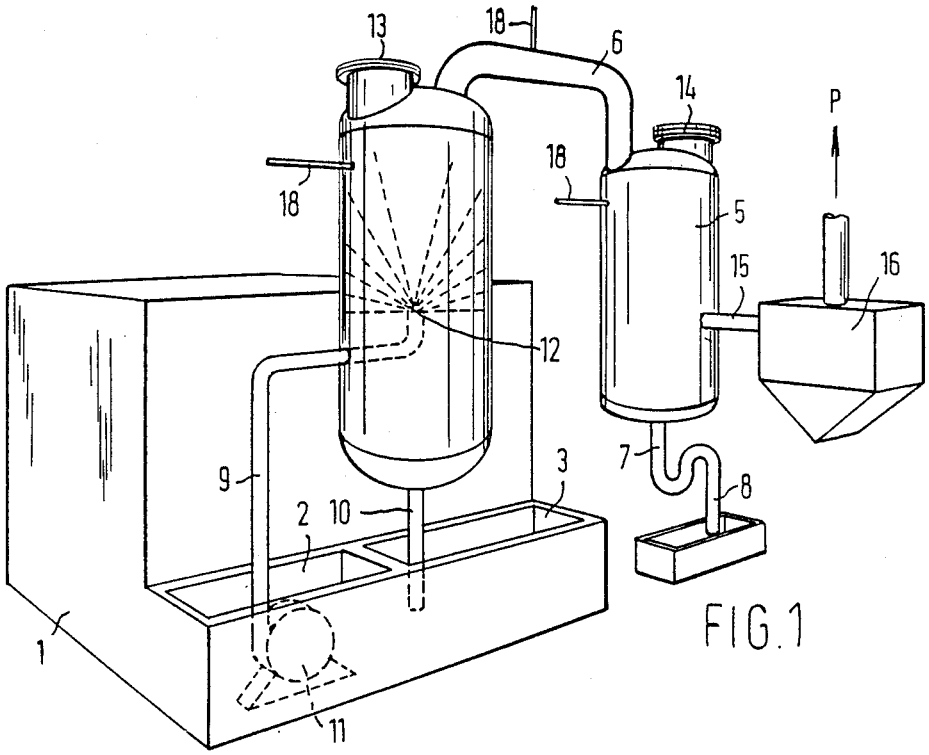

METHOD OF, PURIFYING A MELT, WHICH, BESIDES ONE OR MORE IMPURITIES, ESSENTIALLY CONTAINS A LIGHT METAL, IN PARTICULAR ALUMINUM

This is a division of application Ser. No. 44,928, filed May 1, 1987, now U.S. Pat. No. 4,842,643.

This invention relates to an apparatus for purifying a melt which, besides one or more metallic impurities of relatively high vapour pressure which can be volatilized, essentially contains a light metal, in particular aluminum, said apparatus comprising a vacuum processing vessel, a means for creating subatmospheric pressure in said vacuum processing vessel, one or more conduits for the supply of the melt to said vacuum processing vessel, and means for spraying the melt into said vacuum processing vessel.

Netherlands patent No. 172,464 discloses an apparatus designed for simultaneously purifying and preparing light-metal alloys, in particular aluminum alloys. For this purpose, the contemplated alloy elements are previously provided in the vacuum processing vessel, which is subsequently evacuated. Under the influence of the prevailing partial vacuum, the melt of the metal to be alloyed is 'sucked in' and horizontally supplied to the vacuum processing vessel in the form of one or more jets, whereby simultaneously, at the prevailing partial vacuum in the vessel, a degassing process takes place, the concentration of impurities is decreased and the alloy elements are dissolved and mixed with the melt collecting in the vessel. In this prior apparatus, the transport and supply of the melt to be processed to the vacuum processing vessel is effected exclusively under the influence of the partial vacuum in the vessel. In addition, the processing of the melt, that is to say, purification and alloying, exclusively takes place batchwise.

French patent No. 918,574 also discloses an apparatus for purifying metals and alloys, the purification in this case only being an expulsion of gas dissolved in the metal. In that prior apparatus, the vacuum processing chamber is disposed below the vessel containing the supply of melt to be purified. Through an opening in the bottom of this supply vessel, the melt to be processed falls downwards into the vacuum processing chamber. In one embodiment of the prior apparatus, the degassed melt is continuously discharged from the vacuum processing vessel.

U.S. Pat. No. 4,456,479 discloses a process for refining an aluminum melt, in which metals with a lower vapour pressure than the parent metal are removed by spraying the melt batch contained in a container or can into a chamber to be placed on the can. The chamber is provided with a riser tube and a downcomer tube which extend into the melt batch to be refined. The spraying of the melt to be refined is accomplished by forcing the melt in the riser tube, by means of a carrier gas, upwards to the chamber, in which a partial vacuum is maintained. When the melt enters the chamber, the melt is sprayed partly under the influence of the prevailing partial vacuum. The melt collecting in the bottom of the chamber is recycled to the pan through the downcomer tube.

Austrian patent No. 333,452 discloses an apparatus for degassing a metal melt, for example, an aluminum melt. The apparatus comprises a melt container that can be hermetically closed and is connected to a vacuum pump and is further provided with a heater. Furthermore, a pump is provided within the container, by means of which the melt is raised within the container and, through its delivery line, sprayed into the space above the melt, which is under a reduced pressure. So long as the melt contains gas dissolved therein, such as hydrogen, the melt is sprayed, whereby this gas is separated from the melt. The spraying effect ceases when all of the dissolved gas has been expelled from the melt.

It is an object of the present invention to provide a novel apparatus for purifying light-metal alloys, in particular aluminum alloys, with a broad field of application, ranging from a fast thorough removal of gases dissolved in the melt to the possibility of removing undesirable or less desirable metal components from the melt.

For this purpose, according to the invention, there is provided an apparatus of the kind recited in the opening paragraph hereof, and which is characterized in that the vacuum processing vessel is provided with discharge means for the discharge of one or more impurities expelled from the melt, said discharge means being connected to a separating means for separating one or more impurities in solid or liquid form, connected to a vacuum pump by means of which a subatmospheric pressure can be maintained in said vacuum processing vessel; at least one supply conduit and one return conduit being connected to the vacuum processing vessel, said supply conduit being usable for the supply of melt to be purified to said vacuum processing vessel and being provided with a pump means for the melt to be purified and a spraying means for atomizing melt supplied by the pump into the vacuum processing vessel, the return conduit being applicable for the discharge of purified melt from the vacuum processing vessel.

In the apparatus of the present invention, the vacuum processing vessel and the means for separating impurities, in the absence of non-condensable impurities, form a diffusion pump system of high capacity. This makes it possible, in contrast to systems operating with an auxiliary gas or carrier gas, to use a vacuum pump of low capacity.

By supplying the melt to be processed through the supply conduit to the vacuum processing vessel by a pump means, in accordance with this invention, whereby the melt passes a spraying means incorporated in the supply conduit, a vigorous atomization of the light-metal melt, for example, an aluminum melt, can be achieved. As a result, a large reaction area is obtained, which makes for good transfer of matter. Thus the apparatus according this invention makes it possible to expel from the melt consisting of, for example, aluminum contaminated with zinc or with zinc and magnesium, not only the undesirable gases dissolved in the melt, but also the zinc in the vaporous form, and to withdraw it from the vacuum processing vessel for it to be thereafter separated in an effective manner.

The purified aluminum melt collecting in the bottom part of the vacuum processing vessel can be discharged from the vacuum processing vessel through the return conduit. Advantageously, the supply conduit is connected, or the supply conduit and the return conduit are both connected, either directly or indirectly, to the bath of the melt to be purified, which bath may, for example, be maintained in a furnace. Thus it is possible for the melt bath being purified to be recycled one or more times, in which connection it is effective for the vacuum processing vessel to be disposed at about barometric height above the level of the bath of the melt to be purified and for the supply conduit and the discharge conduit to be respectively formed as a riser tube and a downcomer tube so that a liquid seal can be maintained in the downcomer tube, and the light-metal melt being processed can be automatically discharged from the vacuum processing vessel through the liquid seal.

As used herein, the term 'spraying means' should not be interpreted too narrowly. Thus, for example, spraying can also be accomplished by directing the metal stream issuing from the riser tube to a plate (deflector plate), which may have a flat or other configuration. The droplets issuing from the sprayer can be reactivated by impringing them upon a flat surface. If desired, this can be repeated one or more times.

The apparatus according to the invention makes for a purification process that can be controlled in a more flexible manner if it is provided, in accordance with this invention, with means for the supply of oxygen gas or oxygen producing materials to the vacuum processing vessel and/or a point downstream of said vacuum processing vessel. When the light-metal melt to be purified is contaminated with, for example, zinc and/or magnesium, the separating means of the apparatus according to the invention may be a particles separating means which is connected through a connecting conduit to the vacuum processing vessel, said connecting conduit being provided with means for the supply of oxygen gas or oxygen producing materials. The zinc withdrawn from the vacuum processing vessel in the form of a vapour react(s) with the oxygen to form zinc and/or magnesium oxide particles, which can be separated in the particles separating means, for example a dust filter.

In another embodiment of the apparatus of the present invention, it is possible to separate vapour of a sublimable material, such as zinc vapour, withdrawn from the vacuum processing vessel, by precipitation as solid metallic zinc in a condenser. For periodic removal of the zinc metal, the condenser may be provided with a closable tap, and further with means for melting out the collected zinc metal. If the apparatus according to the invention takes the form in which it comprises a condenser and is combined with supply means for oxygen gas or oxygen producing materials, these means are destined exclusively for supply to the vacuum processing vessel. The condenser is, for that matter, also suitable for separating impurities in the liquid from therein. Although less recommendable, this condenser could also be used, if desired, when the means for supplying oxygen gas or oxygen producing materials are connected to the connecting conduit downstream of the vacuum processing vessel.

Advantageously, and in accordance with a further elaboration of the apparatus according to this invention, the vacuum processing vessel and the supply and return conduit are preheatable. For this purpose there are various possibilities, for example, inductive or electric heating or also by means of a burner.

The melt atomizing effect in the vacuum processing vessel can be promoted still further by using, in accordance with a further embodiment of this invention, a mechanical and/or inductive pump in combination with a pump of the gas-lift principle as the pump means for the melt to be purified.

For better control of the process to be conducted in the apparatus according to the invention, a diaphragm may be provided in the connecting conduit between the processing vessel and the separating means. The main function of such a diaphragm is to control the diffusion pump system.

In accordance with the above the invention also relates to a method of purifying a melt which, besides one or more metallic impurities of relatively high vapour pressure which can be volatilized, contains essentially aluminum, which method is characterized, in accordance with this invention, by maintaining the aluminum melt to be purified at a temperature of 600°–900° C., pumping it by the pump means through the supply tube to the vacuum processing vessel and spraying it into said vessel while maintaining a subatmospheric pressure in the vacuum processing vessel and in the separating means for separating impurities in solid or liquid form, by means of the vacuum pump; discharging the processed light-metal melt collected in the bottom part of the vacuum processing vessel from said vacuum processing vessel through the return conduit and withdrawing the vapour formed in the vacuum processing vessel by means of the vacuum pump.

Effectively the melt to be purified is maintained at a normal storage temperature in an aluminum furnace of 710°–740° C.

As, in the apparatus according to the invention, the partial vacuum to be maintained in the vacuum processing vessel and the separating means, such as the condenser vessel, is not partly used for sucking in and spraying the melt being processed, the partial vacuum to be set may, if desired, be used as a means for controlling the purification process. Thus, for example, the vapour pressure of zinc in equilibrium with 0.1% zinc dissolved in aluminum is sufficiently high for the method according to the invention in which the zinc is separated from the aluminum melt to proceed at a high rate. On the other hand, the vapour pressure of magnesium that is in equilibrium with 0.1% magnesium dissolved in aluminum is considerably lower, so that, at the relatively high pressure usable for the removal of zinc the separation of the magnesium will lag behind considerably.

If zinc has to be removed only, it is effective to maintain a pressure of 0.05–20 mbar (0.005–2 kPa), preferably 0.1–5 mbar (0.01–0.5 kPa) in the vacuum processing vessel, and when magnesium only is removed a pressure of 0.01–0.05 mbar (0.001–0.05 kPa), preferably 0.02–0.02 mbar (0.002–0.02 kPa).

Surprisingly it has now been found that by supplying oxygen gas or an oxygen producing material to the vacuum processing vessel, a ready removal of the magnesium can also be realized. The pressure in the vacuum processing vessel is then effectively maintained at 0.05–20 mbar (0.05–2 kPa), preferably 0.1–5 mbar (0.01–0.5 kPa). The manner in which the oxygen is active in this connection is unknown. Possibly, the vapour phase in the vacuum processing vessel contains magnesium vapour which can be oxidized. The magnesium oxide formed partly falls back into the aluminum bath collecting in the bottom part of the vacuum processing vessel. When this processed aluminum melt is recycled to the furnace in which the aluminum melt is maintained, the magnesium oxide carried along will be scorified in the furnace and is removable. The other part of the magnesium oxide formed will be entrained as a solid by the zinc vapour from the vacuum processing vessel to the condenser and remain behind therein. During the periodic melting of the zinc, the magnesium oxide will float on the zinc as a slag, and thus be withdrawn from the condenser and separated in that form.

Thanks to the intense atomization of the melt in the vacuum processing vessel, the removal of magnesium from the aluminum melt to be purified can also be achieved by adding to the vacuum processing vessel chlorine and/or fluorine and/or a material producing chlorine and/or fluorine. It is true that the treatment of an aluminum alloy by means of a halogen or halogen compound is known from Netherlands patent application No. 7612653, but that publication is concerned with the expulsion of sodium from the aluminum alloy, whereby it is the very object for any magnesium that may be present to remain behind in the aluminum alloy.

Figure 2:
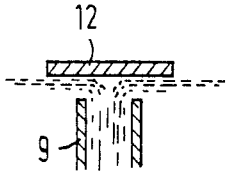
Figure 3:
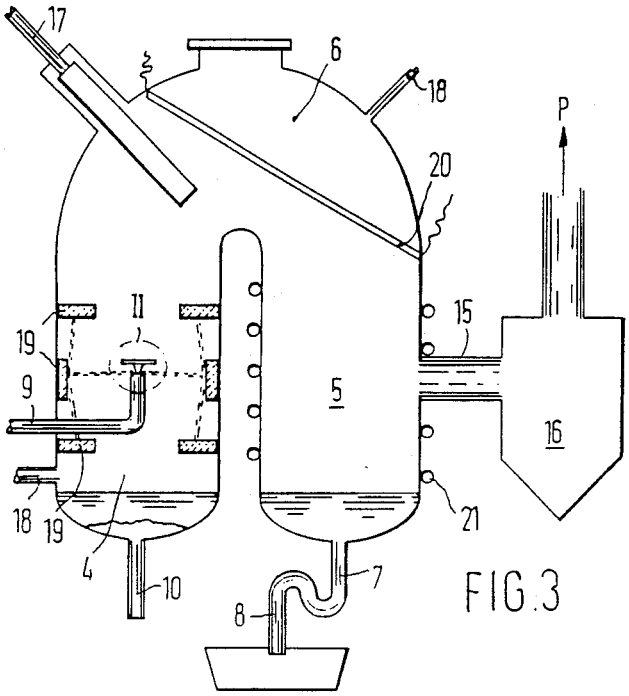

The invention will now be described with reference to the accompanying drawings, which show diagrammatic perspective views of two embodiments of the apparatus according to the invention by way of example. In said drawings, FIG. 1 shows a first embodiment of the apparatus according to the present invention, fitted with a separate connecting conduit between a vacuum procesing vessel and a means for separating one or more impurities in solid or liquid form;

FIG. 2 shows a different embodiment in which the vacuum processing vessel and the separating means for separating impurities in solid or liquid form are an integrated unit without a separate connecting conduit; and FIG. 3 shows, in a larger scale and in cross-sectional view, the encircled detail III of FIG. 2.

In the embodiment of the apparatus according to the invention as shown, parts with like functions are designated by tee same reference numerals.

In the drawing, there is shown an aluminum melting furnace 1 to which open buffer vessels 2 and 3 are connected as a reservoir for the melt to be processed and as a supply container for melt that has been processed, respectively. Disposed at a barometric height above buffer vessel 2,3 is a vacuum processing vessel 4. This vessel 4 is connected through a conduit 6 to a condenser vessel 5. Condenser vessel 5 is in turn connected through conduit 15 and through dust separator 16 to a vacuum pump not shown (arrow P). Condensor vessel 5 is further provided at the bottom with a closable tap 7 which through line 8 is connected to a casting machine not shown.

By means of a diaphragm or slide 17, the effective cross-sectional area of connector 6 (FIG. 1) can be reduced. Oxygen or any other reactions or inert gas can be supplied through connections 18.

Connected further to vacuum processing vessel 4 are a riser tube 9 and a downcomer tube 10, which extend into the open buffer vessels 2 and 3, respectively. Incorporated in riser tube 9 is a lifting pump 11 and a spray nozzle 12. The vacuum processing vessel 4 and condensor vessel 5 each have a door 13,14, respectively, giving access to the interior of vacuum processing vessel 4 and condenser vessel 5, respectively.

In operation, a supply of aluminum melt to be purified is supplied from melting furnace 1 to such a level that riser tube 9 terminates below the bath surface. By means of a vacuum pump, the desired subatmospheric pressure is maintained through conduit 15 in vacuum processing vessel 4 and condenser vessel 5.

The melt in the open buffer vessel 2 is pumped upwards in a continuous stream by pump 11 and atomized into the vacuum processing vessel 4 through spray nozzle 12. The processed aluminum melt collected continuously flows through the liquid seal formed in downcomer tube 10 under the influence of the partial vacuum in vessel 4 to the open buffer vessel 3 and thence back to the melting furnace 1.

In condenser vessel 5, zinc vapour sucked off from the vacuum processing vessel 4 is collected and precipitated. Periodically, this zinc can be molten and removed through tap 7 and conduit 8 to the casting machine, where it can be cast into zinc ingots, for example.

In the embodiment of the apparatus according to the invention as shown in FIG. 2, the vacuum processing vessel 4 and the condenser vessel 5 merge into one another through an integrated connecting conduit 6. The melt supplied through conduit 9 is sprayed not through a spraying nozzle, but by inpinging the jet of aluminum melt upon a deflector plate 12. Owing to the lateral spread of the melt droplets, these can impinge one or more further times upon fixed plates 19 and are thus reactivated upon each impingement. Heating means are shown diagrammatically at 20 and 21.

Naturally, the apparatus as described herein and shown in the accompanying drawing can be modified without departing from the scope of the invention.

Although, by way of example, the removal of zinc and magnesium from an aluminum melt has been discussed in particular, the invention is not so limited. Thus, for example, sodium and cadmium, and also lithium, are volatilizable within the framework of the apparatus and method according to this invention, and to be removed from a light-metal melt in accordance with this invention, while the apparatus and method according to the invention are also applicable to a lead-zinc melt.

I claim:

1. The method of removing volatizable metallic impurities from light metal comprising the steps of maintaining a molten bath of a light metal containing volatizable metallic impurities at a temperature in the range of from about 600° to 900° C., providing a vacuum processing vessel partially filled with metal from said bath, maintaining the pressure within said vessel at a subatmospheric level, forcing a continuous stream of molten metal from said bath under positive pressure into said vessel, causing said metal from said stream of metal to be interposed into said vessel at a level above said molten metal in said vessel through an atomizing device, thereby to cause the metal of said stream to be atomized and said impurities to be volatized while continuously drawing off said volatized impurities under vacuum through a conduit connected to said vessel at a level about said molten metal in said vessel and thereafter discharging said light metal from the molten metal in said processing vessel.

2. The method of claim 1 and including the step of providing a condenser vessel connected to said conduit, continuously maintaining the pressure in said condenser vessel at a subatmospheric level to thereby maintain said vacuum processing vessel at said subatmospheric pressure and removing said impurities collected in said condenser vessel.

3. The method in accordance with claim 2 wherein the bath is maintained at a temperature within the range of from 710° to 740° C.

4. The method in accordance with claim 1 and including the step of introducing oxygen into said vacuum processing vessel.

5. The method in accordance with claim 1 and including the step of removing increments of metal from said vessel at a level below said molten metal in said vessel and reintroducing said removed increments into said vacuum processing vessel as a part of said continuous stream.

6. The method in accordance with claim 1 and including the step of maintaining said vacuum in said processing vessel at a relatively low level and thereafter introducing oxygen into said pressure vessel and increasing the vacuum in said vessel.

7. The method in accordance with claim 2 and including the step of introducing a halogen selected from the group consisting of chlorine and fluorine into said pressure vessel.

8. The method in accordance with claim 1 wherein the pressure in said vacuum processing vessel is maintained in the range from about 0.01 to 20 m b a r (0.001–2. k P a).

9. The method in accordance with claim 8 wherein said metal is introduced into said vacuum processing vessel at pressures in the range of from about 30.4 to about 304 k P a.

* * * * *